US007861662B2

(12) United States Patent
Rista

(10) Patent No.: US 7,861,662 B2
(45) Date of Patent: Jan. 4, 2011

(54) INFLATABLE KAYAK TYPE BOAT AND METHOD FOR MAKING SAME

(75) Inventor: Stefano Rista, Vancouver (CA)

(73) Assignee: Walker Bay Boats, Inc., Yakima, WA (US)

( * ) Notice: Subject to any disclaimer, the term of this patent is extended or adjusted under 35 U.S.C. 154(b) by 283 days.

(21) Appl. No.: 12/235,465

(22) Filed: Sep. 22, 2008

(65) Prior Publication Data

US 2009/0078186 A1 Mar. 26, 2009

Related U.S. Application Data

(60) Provisional application No. 60/974,403, filed on Sep. 21, 2007.

(51) Int. Cl.
*B63B 7/00* (2006.01)

(52) U.S. Cl. ..... 114/345; 114/357

(58) Field of Classification Search ..... 114/345, 114/357; 441/40

See application file for complete search history.

(56) References Cited

U.S. PATENT DOCUMENTS

| | | | | |
|---|---|---|---|---|
| 468,455 | A | 2/1892 | Giessmann | |
| 2,401,252 | A | 5/1946 | Klimashesky | |
| 2,698,020 | A | 12/1954 | Phane | |
| 2,743,510 | A | 5/1956 | Mauney et al. | |
| 3,670,504 | A * | 6/1972 | Hayes et al. | 405/32 |
| 3,931,655 | A | 1/1976 | Luscombe | |
| RE28,916 | E * | 7/1976 | Rice et al. | 5/628 |
| 4,251,893 | A | 2/1981 | McCrory et al. | |
| 4,360,736 | A * | 11/1982 | Weissenfluh | 250/519.1 |
| 4,462,331 | A | 7/1984 | McCrory | |
| 5,868,095 | A | 2/1999 | Zeromski et al. | |
| 6,066,016 | A * | 5/2000 | Yonover | 441/40 |
| 6,209,476 | B1 | 4/2001 | Maurel et al. | |
| 6,863,014 | B2 | 3/2005 | Hudson et al. | |
| 7,185,600 | B2 | 3/2007 | Toussi et al. | |
| 2003/0153221 | A1 * | 8/2003 | Weir | 441/66 |
| 2009/0031941 | A1 * | 2/2009 | Czarnowski et al. | 114/345 |
| 2009/0049757 | A1 * | 2/2009 | Potter | 52/2.23 |

* cited by examiner

*Primary Examiner*—Stephen Avila

(57) ABSTRACT

An inflatable boat comprising an inflation structure which in turn has a drop stitch structure which is made of upper and lower fabric layers and also a core section made up in an array of threads extending throughout the drop stitch structure. The outside contour comprises a watertight/air tight sidewall enclosing the drop stitch structure and there is a seating compartment within the drop stitch structure and an interior wall sealing off the inside of the flotation structure.

20 Claims, 13 Drawing Sheets

INFLATABLE KAYAK TYPE BOAT AND METHOD FOR MAKING SAME

RELATED APPLICATIONS

This application claims priority benefit of U.S. Ser. No. 60/974,403, filed Sep. 21, 2007.

BACKGROUND OF THE DISCLOSURE a) Field of the Disclosure

The present invention relates to an inflatable boat and a method of making the boat. More particularly, the inflatable boat has or may have an overall configuration which is the same as or similar to a kayak, along with a method of making the same.

SUMMARY OF THE DISCLOSURE

These embodiments relate to an inflatable kayak type boat and method. The boat has an overall configuration which may be the same as, or has similarities to, a type of boat which is commonly termed a "kayak". The basic configuration of this boat comprises a main structure which is an inflatable flotation structure having connected front, rear and side portions interconnected pneumatically with one another to form a single flotation chamber so that the pressurized air is present throughout the entire flotation structure. There is a seating compartment located in a mid-location in the structure.

In providing the main structure of the kayak, there is used what is commonly designated a "drop stitch structure". This drop stitch structure comprises upper and lower fabric layers which are connected to one another by means of a core section. The cord section comprises a large number of threads or cords having upper and lower end portions which connect to the upper and lower fabric layers.

The entire inflatable flotation structure can be inflated and deflated through a single air valve. Thus, when inflated, the pressure through the inflatable flotation structure places the structure in an operating mode where it is a substantially rigid structure. Then when it is deflated, the kayak like boat can be folded into a rather compact package.

There is also the method by which these components are combined with one another to form the entire structure with its surrounding inflatable flotation structure and the seating compartment.

DESCRIPTION OF THE EMBODIMENTS

Figures 1, 2:
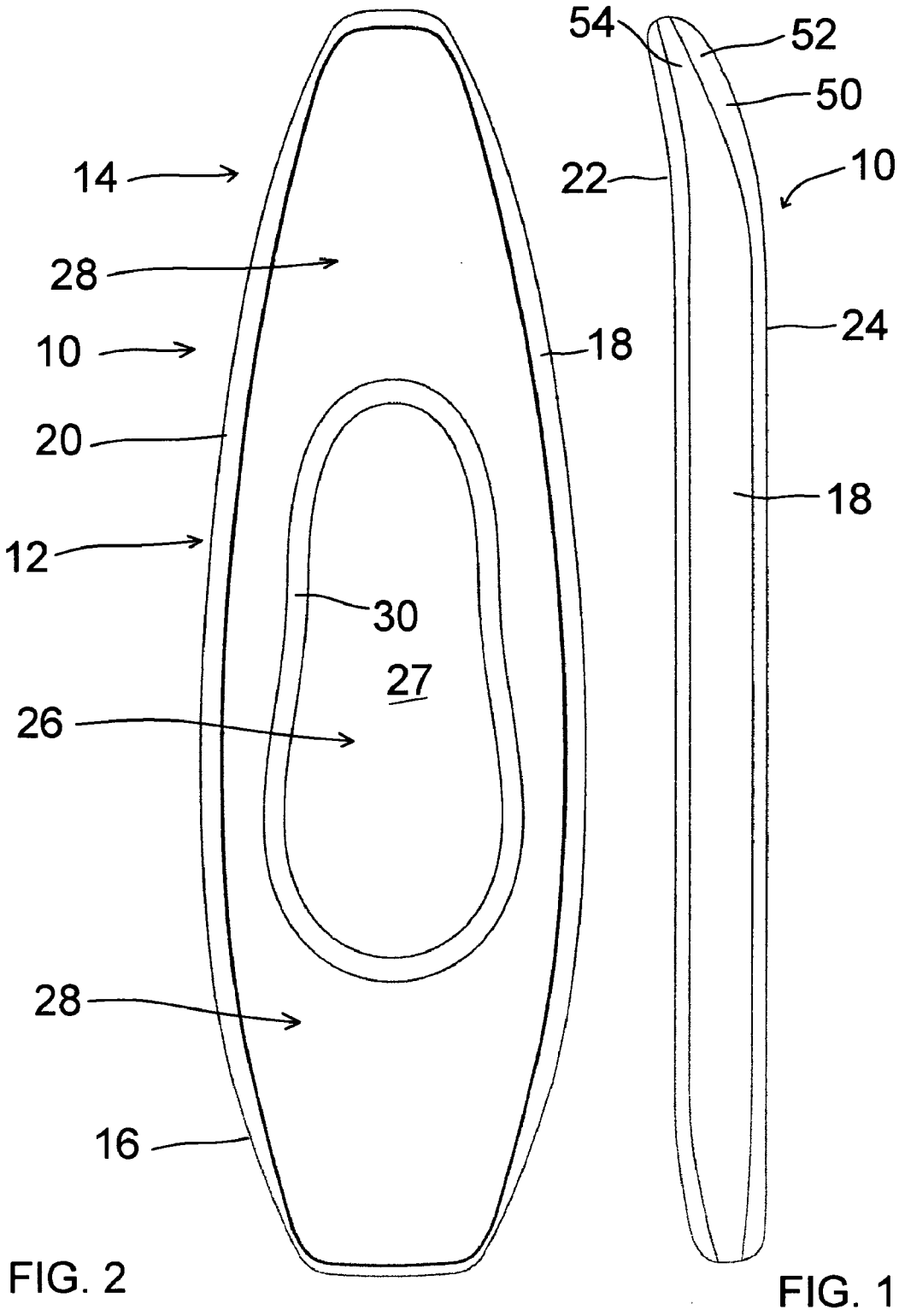
FIG. 1 is a side elevational view of the main structure of a kayak type boat made in accordance with the present invention.
FIG. 2 is a top plan view of FIG. 1.

The specific design of the boat 10 which is the subject matter of the present invention is directed toward a boat which has the overall configuration of a boat which is the same as or has similarities to a boat which is commonly termed a "kayak". However, it is to be understood that the basic configuration and making this kayak could also apply to other types of boats which would be adaptable to this particular method and configuration, but which may be outside the scope of the term "kayak" as it is generally understood. However, for convenience in the present text, the boat will be referred to as the "kayak", with the understanding that it is not necessarily limited to a more limited description of a "kayak", but could be the type of boat having similarities to a kayak.

It is believed that a better understanding of the present invention will be obtained if the description of the invention proceeds in the following sequence. First there will be the overall description of the configuration of the kayak 10 and also its main functional components. This will be followed by a description of what is known generally as a "drop stitch fabric" which functions as the main structural component of the kayak. As will be discussed later in the text, since it has this load bearing function, it will later be referred to as the "drop stitch structure".

This will be followed by identifying and describing the main components that are bonded to one another to form the basic structure of the kayak. Then there will be a discussion of some more specific features and components. Finally, there will be a description of the method of making the kayak and also presenting some final considerations.

The basic configuration of the kayak 10 will now be discussed with reference to FIGS. 1 and 2 which show the main structure of the kayak. The kayak 10 has a mid-section 12, front and rear sections 14 and 16, and right and left side sections 18 and 20. Also, there are top and bottom surface regions 22 and 24, and a the kayak 10 seating region 27 and which there is a seating compartment 26 defined by a floor 28 and an inner seating compartment sidewall 30.

The main part of the kayak comprises an inflatable flotation structure 31 which functions as substantially the entire support structure within which the seating compartment 26 is situated. This flotation structure 31 comprises the front and rear sections 14 and 16 and also the side sections 18 and 20.

Figure 3:
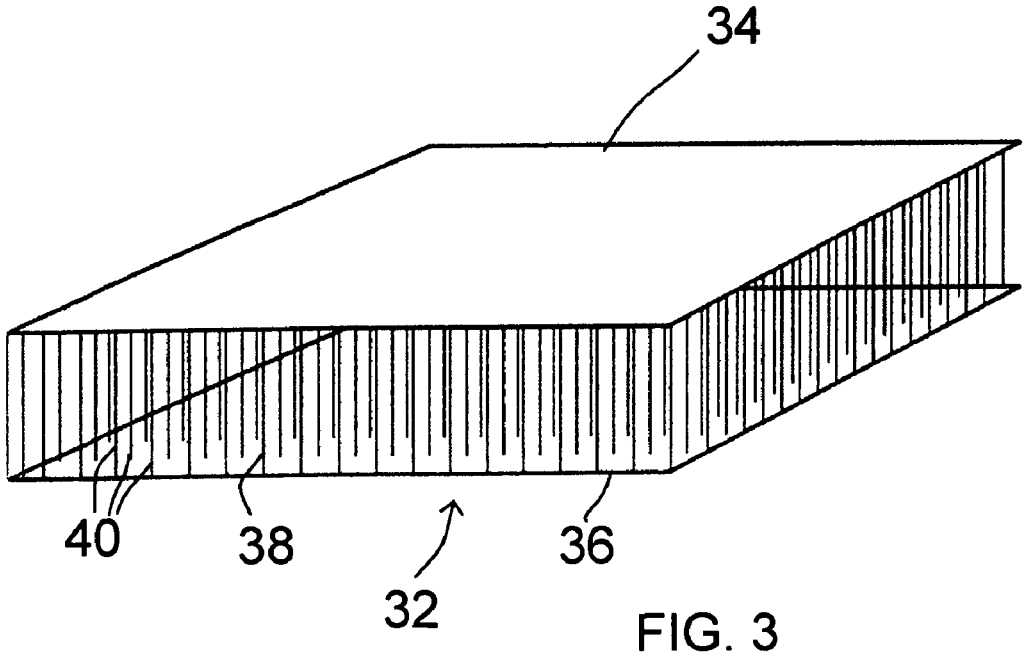
FIG. 3 is an isometric drawing illustrating a drop stitch structure that is used in the present invention.

In providing the basic structure of the kayak 10 of the present invention, there is used what is commonly called a "drop stitch fabric" 32 which is shown in FIG. 3. As shown in FIG. 3, the "drop stitch fabric" 32 comprises upper and lower fabric layers 34 and 36, with a core section 38 positioned between (and connected to) the upper and lower fabric layers 34 and 36. This core section 38 comprises a plurality of individual threads or cords 40 which have upper and lower end portions which connect to, respectively, the upper and lower fabric layers 34 and 36.

However, in some instances the technical literature would use the term "drop stitch" to mean the entire assembly of the upper and lower layers with the threads or cords already connected or to mean only the threads or cords. Therefore, since this drop stitch fabric performs a structural function in its inflated condition, in the following text instead of using the commonly used phrase "drop stitch fabric" to define the entire structure shown in FIG. 3, for clarity, this will be referred to as the "drop stitch structure". Also, as indicated above, this term covers the entire structure which comprises the upper and lower fabric layers 34 and 36, and also the core section 38 which comprises the threads 40.

Figure 4:
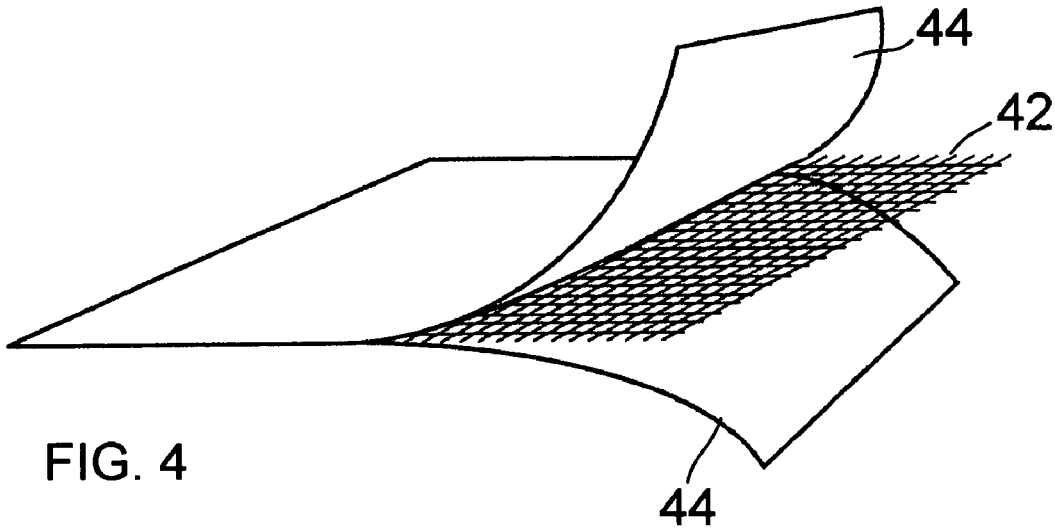
FIG. 4 is an isometric drawing showing an upper or lower fabric sheet of the drop stitch structure of FIG. 3.

To explain this further, attention is directed toward FIG. 4 in which a portion of the drop stitch fabric layer 34 or 36 is split apart for purposes of illustration. The upper and lower fabric layers each may consist of bi- or tri-axial polymer threads 42 (see FIG. 12) which are laminated between two very thin polymer layers 44 (in this particular example the polymer is PVC layers) to form the polymer fabric layers 34 and 36. The final fabric layer 34 or 36 may be approximately 0.5 to 1 mm thick. Each layer 34 and 36 is both water and air impervious and is quite flexible in its non-inflated condition.

The upper and lower ends of the threads 40 of the drop stitch core section 38 are embedded within the upper and lower fabric layers 34 and 36. This is done in a manner that the drop stitch structure is able to withstand rather heavy loads. For example, when the drop stitch fabric has a closed interior which is pressurized, it can withstand pressures up in the range of eight to ten PSI (pounds per square inch) and quite possibly much larger loads.

Figure 6:
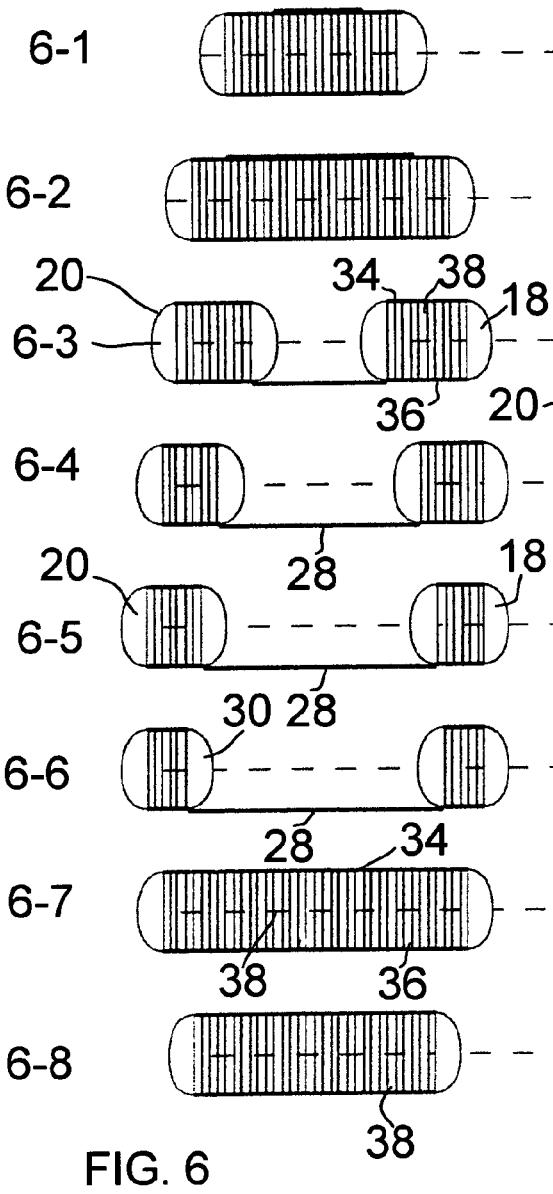
FIG. 6 is made up of eight different cross-sectional drawings labeled 6-1 to 6-8 showing eight cross-sectional locations of the kayak structure of FIG. 5.
Figure 5:
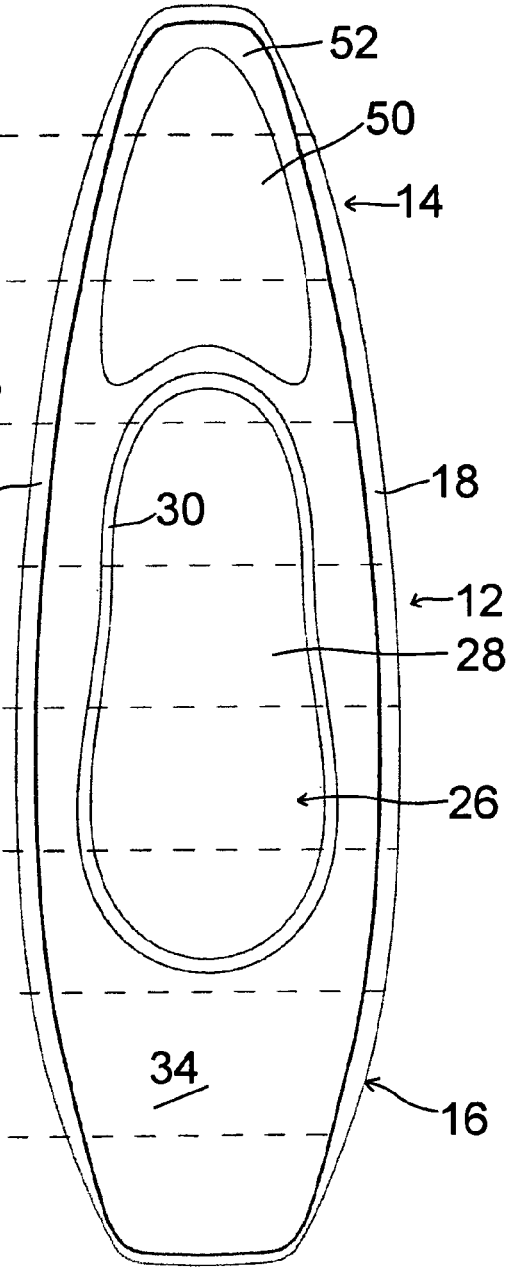
FIG. 5 is a view quite similar to FIG. 2, but indicating the locations of sectional views of FIG. 6.

To describe the overall configuration of the kayak 10, reference is now made to FIGS. 5 and 6. It can quickly be recognized that FIG. 5 (with one exception) is the same as FIG. 2. To explain in the configuration of the structure of the kayak 10, FIG. 6 and FIG. 5 are shown side-by-side with horizontal broken lines indicating the same front-to-rear locations. In FIG. 6 there are shown eight cross-sectional sections along the length of the kayak 10 and these are identified by the numerals 6-1 through 6-8, and broken lines extend from each of these sections 6-1 to 6-8 to show the corresponding location as seen on a top plan view of the kayak 10. These two sidewalls 18 and 20 function as a sidewall section and completely enclose the outside perimeter of the drop stitch structure 32.

It is important to note that the core section 38 which is made from the drop stitch structure is present in all eight cross-sectional FIGS. 6-1 through 6-8 and also extends through the entire length of the kayak 10. Also the right and left sidewall portions 18 and 20 are present in all eight cross-sectional drawings of FIGS. 6-1 through 6-8, and these two, along with its adjacent upper and lower fabric layers 34 and 36 extend the entire length of the kayak and overlap each other at the front and rear end locations of the kayak 10.

Now we turn our attention to the seating compartment 26. This seating compartment 26 has an entire interior border wall 30 which extends around the entire perimeter of the seating compartment 26. The floor 28 shows up only in cross-sectional views of 6-3, 6-4, 6-5, 6-6 and 6-8, and the floor 28 covers the entire floor area defined by the inside wall 30.

As can be seen in FIGS. 5 and 6, the two sidewalls 18 and 20 and the inner border wall 30 completely enclose the region of the core structure to make it totally closed and air tight so that the total interior of the core structure 38 can be inflated.

Thus, as illustrated in FIGS. 5 and 6, there are a total of five main components which make up the basic structure of the kayak 10. These are as follows:

i) the right sidewall 18;

ii) the left sidewall 20;

iii) the drop stitch structure 32 which is made up of the upper and lower fabric layers 34 and 36 and also the core section 38 made up of an array of threads 40 extending throughout the drop stitch structure;

iv) the inside border wall 30 that defines the seating compartment 26 and also closes the inside edge portion of the drop stitch structure 32 to do its part in making the flotation structure air tight; and v) the floor 28 of the seating compartment 26.

There is also shown in FIG. 5 a reinforcing member 50 which is shown at the upper front surface portion of the kayak 10. This is a layer of a flexible fabric layer which is, or may be the same as, or similar to, the fabric layer that make up the sidewalls 18, 20 and 30. The function of this reinforcing member 50 is to cooperate with the upturned front ends 54 (see FIG. 1) of the sidewalls 18 and 20 at the front end of the kayak 10 to exert a restraining force to contribute to the curved upward slant of what we call the "nose" 52 of the kayak.

Now with reference to FIGS. 7 through 18, the method of the present invention will now be discussed.

Figure 7:
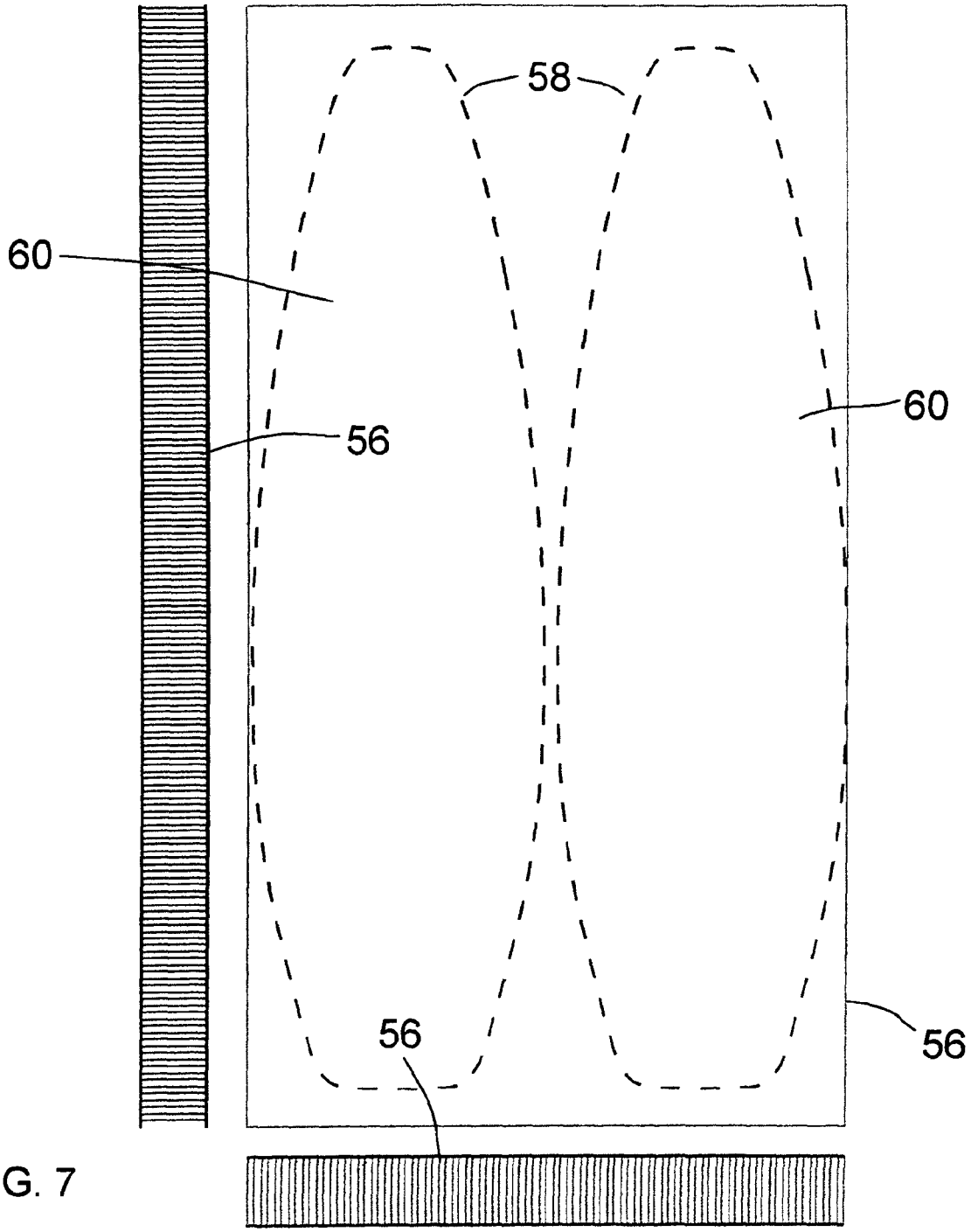
FIG. 7 is a plan view showing cutout sections of the drop stitch structure and two side views in accordance with the method of the present invention.

As a first step in FIG. 7, there is shown a block or section 56 of the drop stitch structure material from which two intermediate drop stitch structure members are to be cutout. Thus, there are shown two cutout lines 58, each having an elongate configuration which matches closely the drop stitch structure 32. The block 56 of the drop stitch structure material is cut along these lines 58 to form a pair of intermediate drop stitch structure members 60, but with only one of these being used in making this one kayak.

Figure 8:
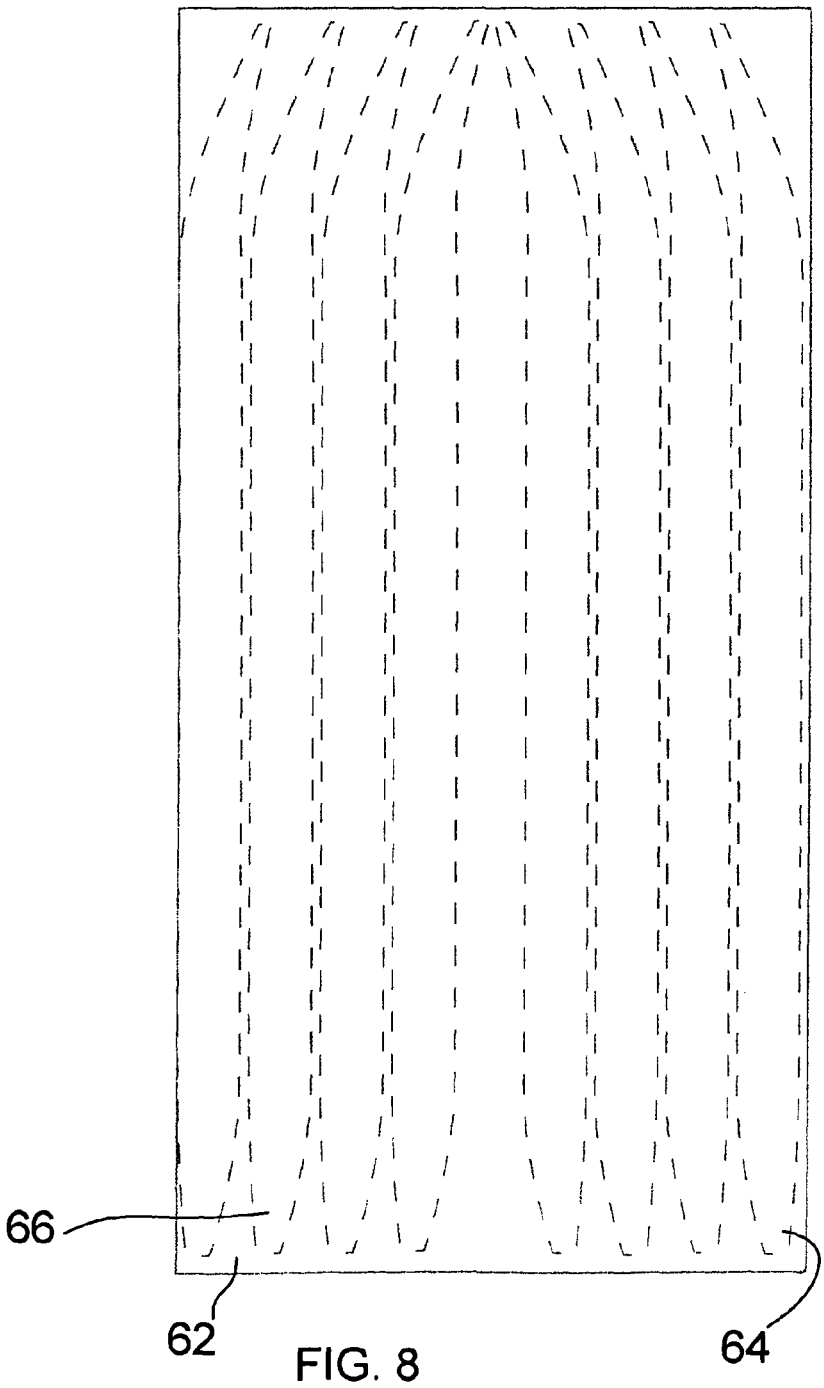
FIG. 8 is a view of a sheet of fabric showing cutout lines of a plurality of sidewall portions in accordance with the method of the invention.
Figure 9:
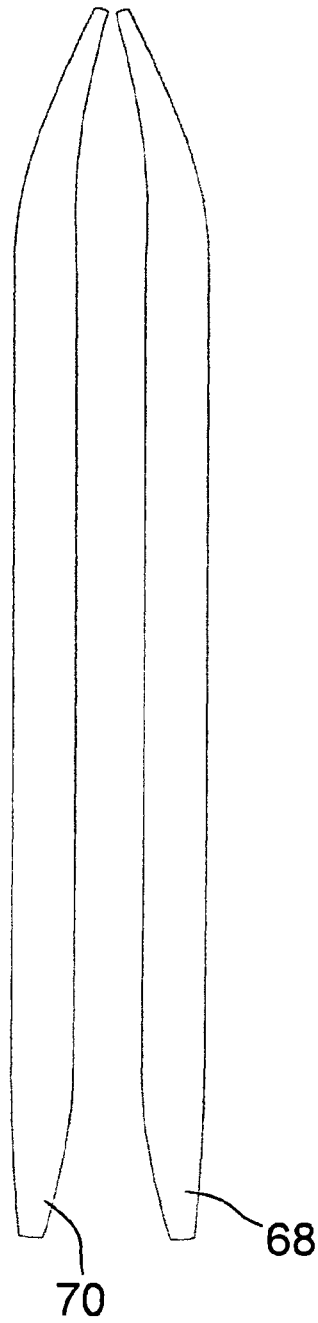
FIG. 9 shows a pair of right and left sidewall portions that have been cut out and removed from the cutout location.

As a second step, in FIG. 8 there is shown in plan view a flexible, waterproof, air tight layer 62 and there is shown a plurality of cutout lines 64 and 66 which match the contours of the right and left sidewall members 18 and 20. The layer 62 is cut along these lines to form two sets of the right and left sidewall members 68 and 70. A single one of each of these is shown in FIG. 9, and these two members 68 and 70 are used in step 4 to form the right and left side sections 18 and 20, with six members 68 and 70 left over.

Figure 10:
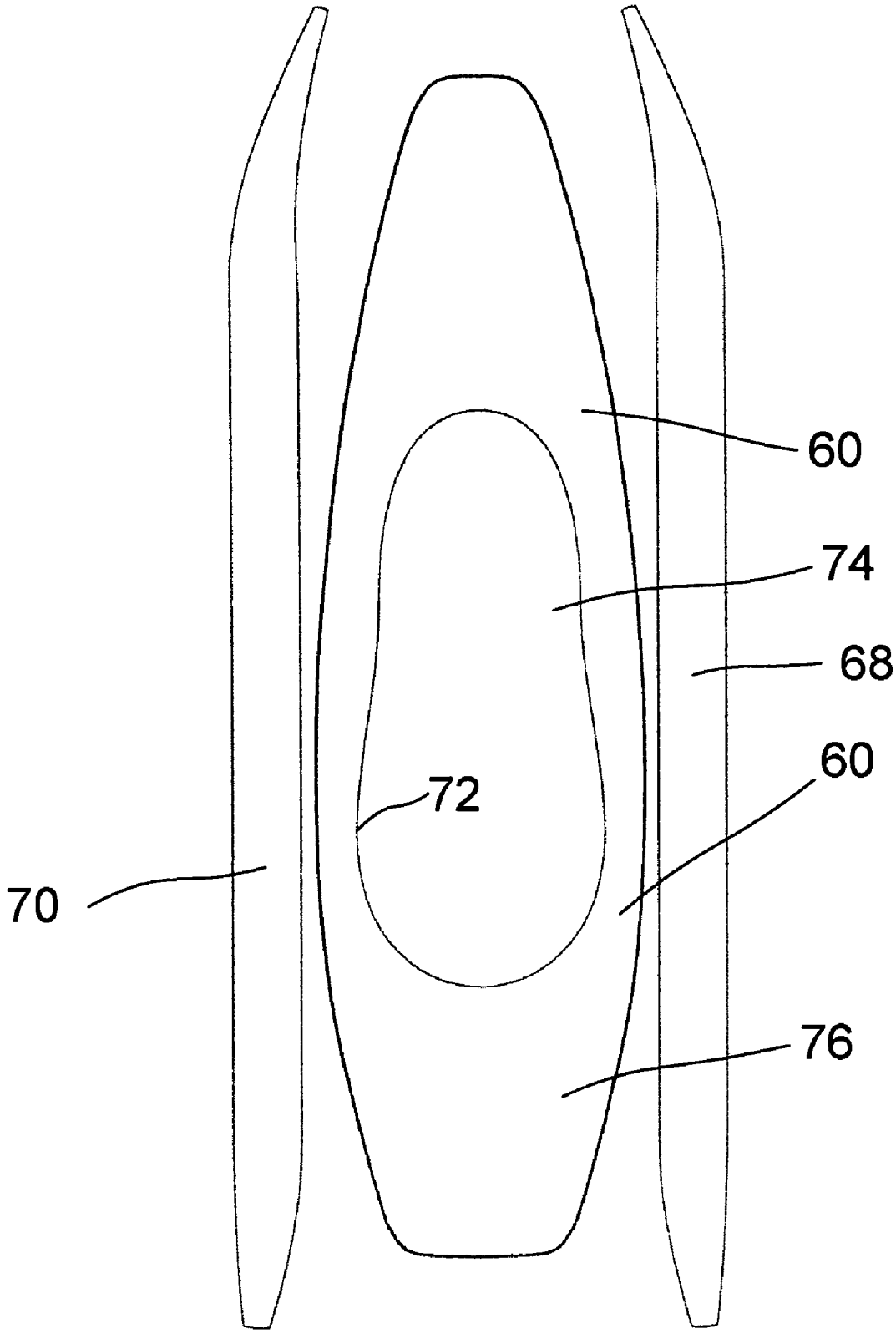
FIG. 10 is another view relating to the method, showing the two sidewall portions in a location to be joined to a drop stitch structure.

To describe a third step, reference is first made to FIG. 10. There is shown in FIG. 10 one of the drop stitch structure contour cutouts 60 shown in FIG. 7. There are also shown in Fig.10 on opposite sides of this cutout structure 60 a pair of the right and left side members 68 and 70. This third step is to cut a central portion of the drop stitch structure 60 along a cutout line 72 which matches the contour of the seating compartment 26. In FIG. 10, there is shown that this cutout portion has been removed, leaving an open space 74 which is to become the seating region 27.

Figure 11:
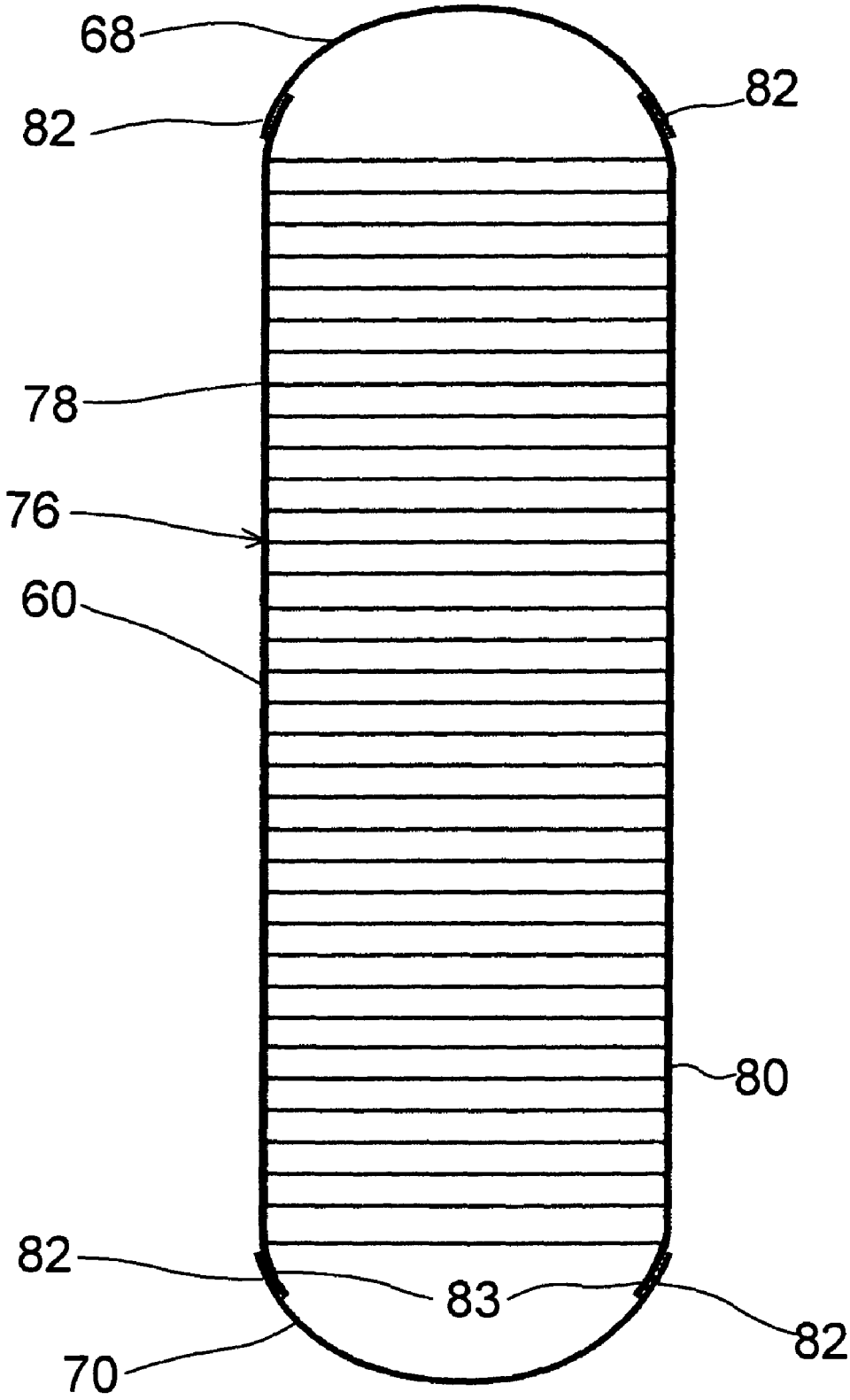
FIG. 11 is a sectional view showing one method in which components are joined in the kayak.

The fourth step is to bond edge portions of the two sidewall members 68 and 70 to upper and lower edge portions of the drop stitch structure member 72 formed with its open region 74. This is accomplished in a first way as shown in FIG. 11 where there are shown the upper and lower fabric layer portions 78 and 80 of the drop stitch structure 76. It can be seen that there are four areas of overlap of the edge portions 82 of the sidewall cutouts 68 and 70 that overlap the outer edges 83 of the upper and lower sheets 78. However, there is a possibility that this overlap could be reversed so that the two edges 83 of the fabric layers 78 and 80 would overlap the edges 82 of the side members 68 and 70. As another alternative, there could simply be an extra member overlapping both edges 82 and 83 and making the connection.

Figure 12:
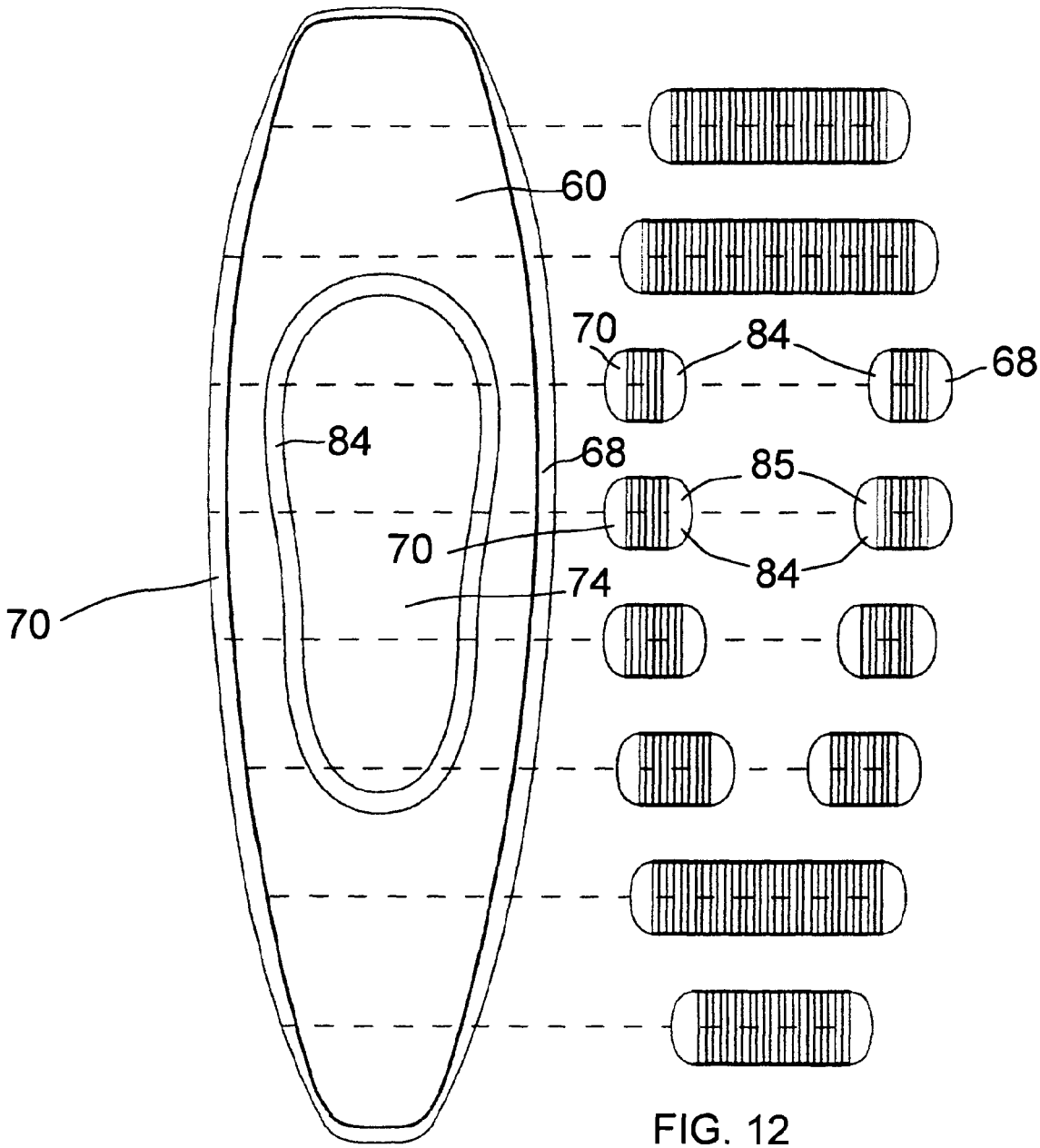
FIG. 12 shows two drawings similar to FIGS. 5 and 6, but which are presented without the floor to illustrate a step in the method.

The next step is to properly position and bond to the drop stitch structure the inside border wall 30 that surrounds and defines the seating compartment 26. This is done in substantially the same way as described above with regard to the outer sidewalls 18 and 20. The procedure is to make a cutout of an elongate fabric strip having the proper width dimension to connect in overlapping relationships with the upper and lower fabric layers 78 and 80 of the drop stitch structure 74. In FIG. 12, there is shown an inner fabric layer strip 84 which has a contour that matches the mid-cutout region 72 of the drop stitch structure 60. This inner wall 84 can be made by a single fabric layer 85 which is placed around the entire cavity and overlaps at a juncture location with the drop stitch structure.

Figure 13:
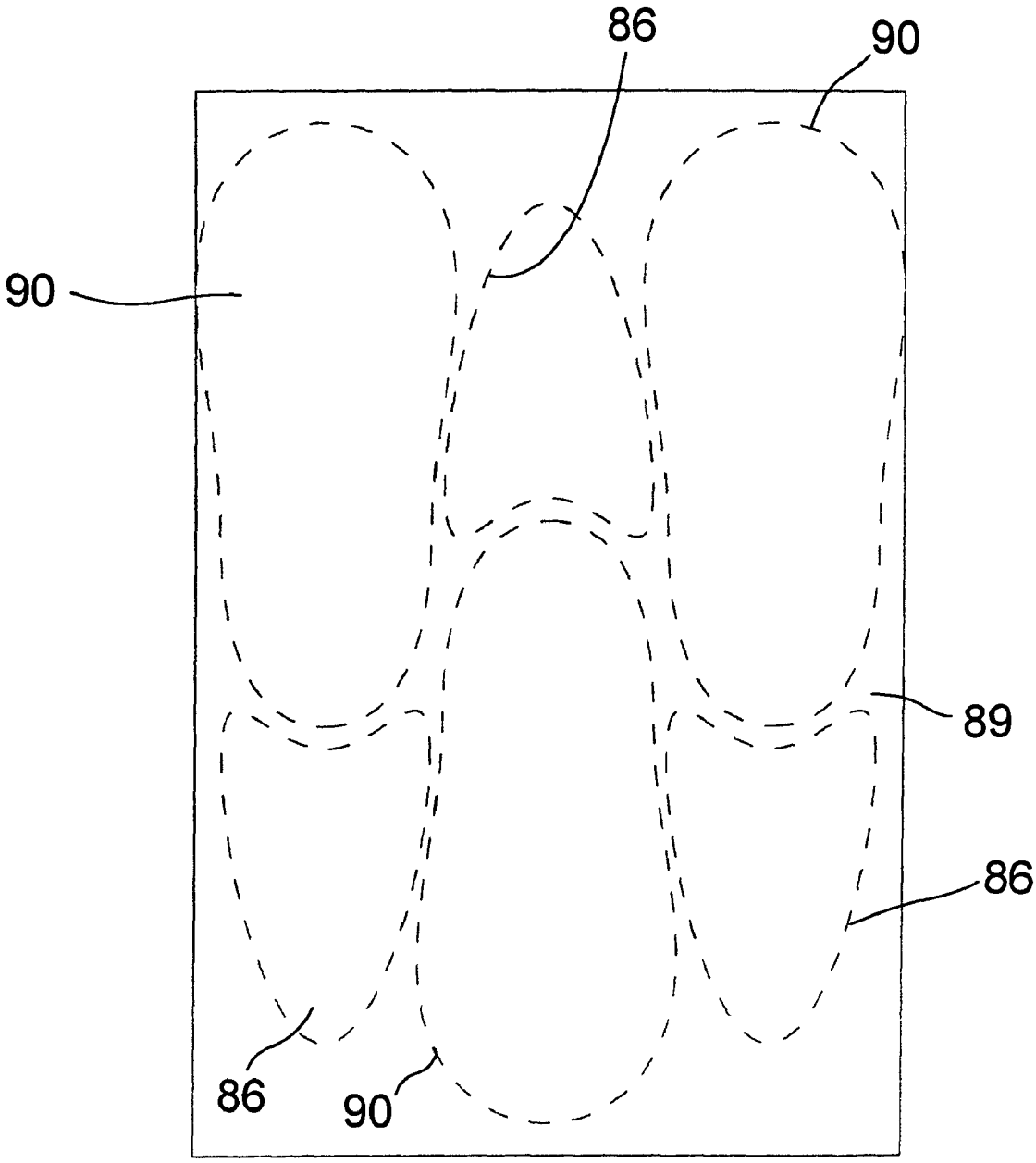
FIG. 13 is a plan view of a fabric similar to that shown in FIG. 8, showing other cutout lines for components of the invention.

To go to the next step in the method, reference is made to FIG. 13. There is shown a fabric sheet 89 which is the same as, or similar to, the fabric sheets shown in FIG. 8. There are six separate closed cutout lines. There is one set of three cutout lines 86 which match the configuration of the previously mentioned reinforcing member 50 which is shown in FIG. 5, and which functions to cooperate with the other components at the front of the kayak to cause the lifting of what we call the "nose 52" of the kayak.

Figure 14:
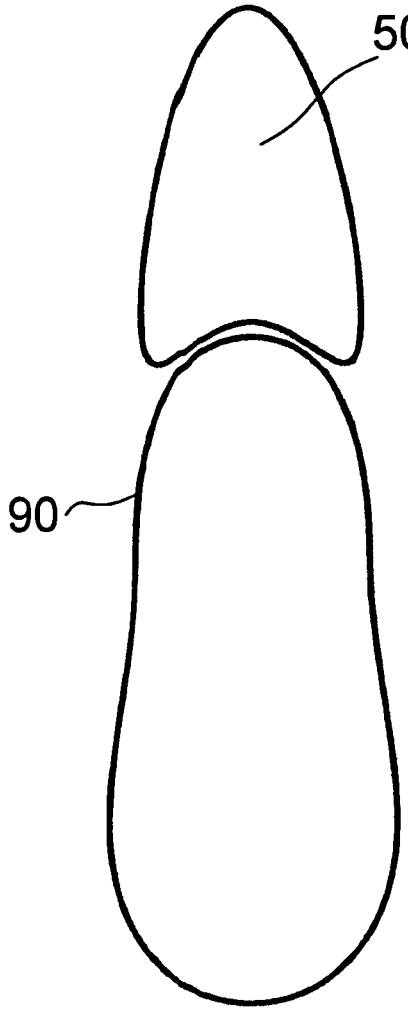
FIG. 14 is a plan view showing two components cutout as in FIG. 13 to be added to the kayak.

The other three cutout lines 90 follow the contour of the floor member 28 and each member which results by being cutout along the line 90 becomes a floor member 28. These two separate cutout members which are shown in FIG. 14 are designated 50 and 28, respectively and are shown installed in the immediately adjacent FIG. 15 and also in FIG. 16. These are shown having been put into place by being bonded to the kayak's structure.

Figure 15:
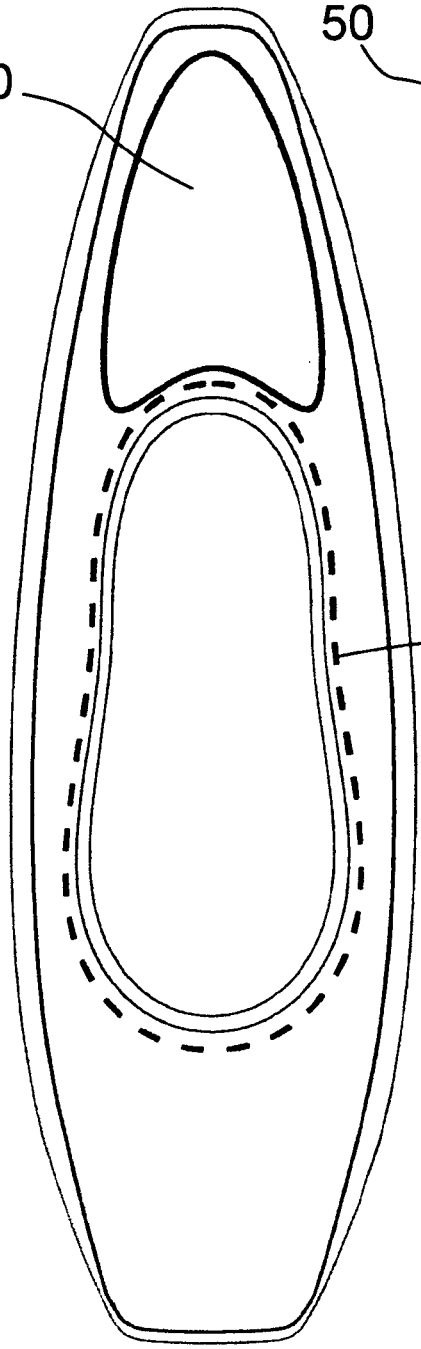
FIG. 15 is a top plan view illustrating the positioning of the two components of FIG. 14 in the kayak.

Thus, in FIG. 15 there is seen the forward reinforcing member 50 which, as indicated earlier, helps to provide the upturn configuration of the nose portion 50. Further, we see the member cutout along line 90 has now become bonded to the perimeter of a lower surface of the lower part of the inside wall member 30 and the adjacent lower inner surface portion of the drop stitch fabric structure to become (and function as) the floor 28.

Figure 16:
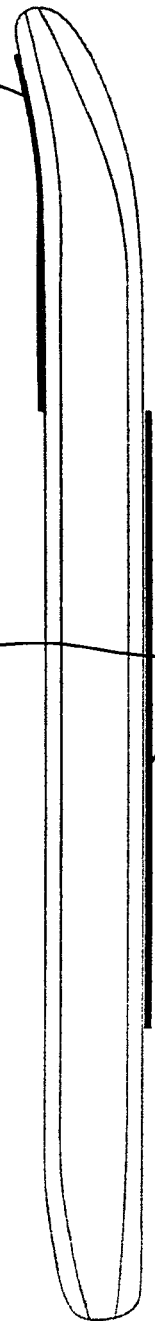
FIG. 16 is a side elevational view of the kayak as shown in FIG. 15, emphasizing the location of the two members shown in FIG. 14.

In FIG. 15, the floor member 28 is shown in plan view and the side elevation view of FIG. 16, and its perimeter is indicated at 28 by a heavy broken line in FIG. 15.

Figure 18:
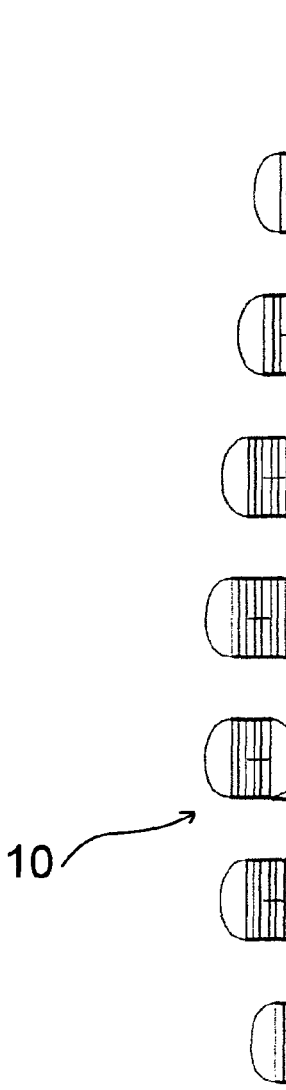
FIG. 18 is a view similar to FIG. 6, showing in cross-section at eight different locations the configuration of the kayak of FIG. 17.
Figure 17:
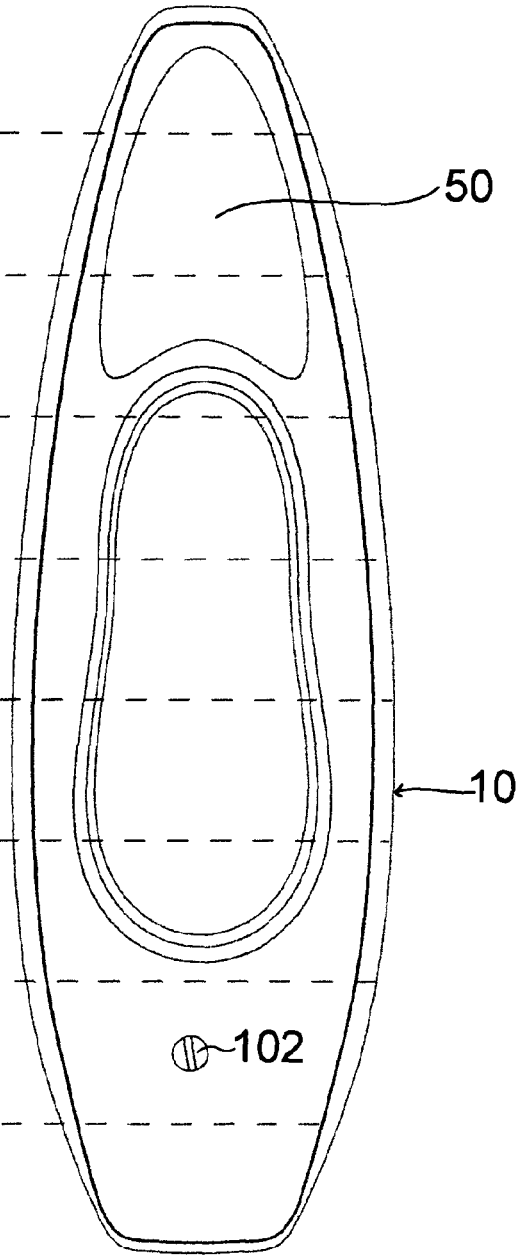
FIG. 17 is a top plan view similar to FIG. 5.

FIG. 18 shows the very same kayak as shown in FIG. 6, with the exception that there is now included a removable cushion seat 100, and FIG. 17 also slows in plain view. Since this cushion seat is made with substantially the same components with the same method as described above with regard to the kayak itself, this will not be discussed any further in this text.

All of the components of this kayak are totally flexible in the un-inflated condition. Further, all of the components, including the upper and lower layers of the drop stitch structure, are water impervious and also air impervious so that the inflated air can be maintained, and there was no leakage of water.

In the collapsed position, the kayak can be folded to occupy a very small space. To inflate the kayak 10, there is provided an air-valve through which it can be inflated and deflated, and this is indicated schematically at 102 in FIG. 17. With the kayak inflated to approximately eight to ten PSI, the surface of the inflated portions of the boat are quite firm and the entire structure of the boat maintains its configuration of the kayak.

Figure 20:
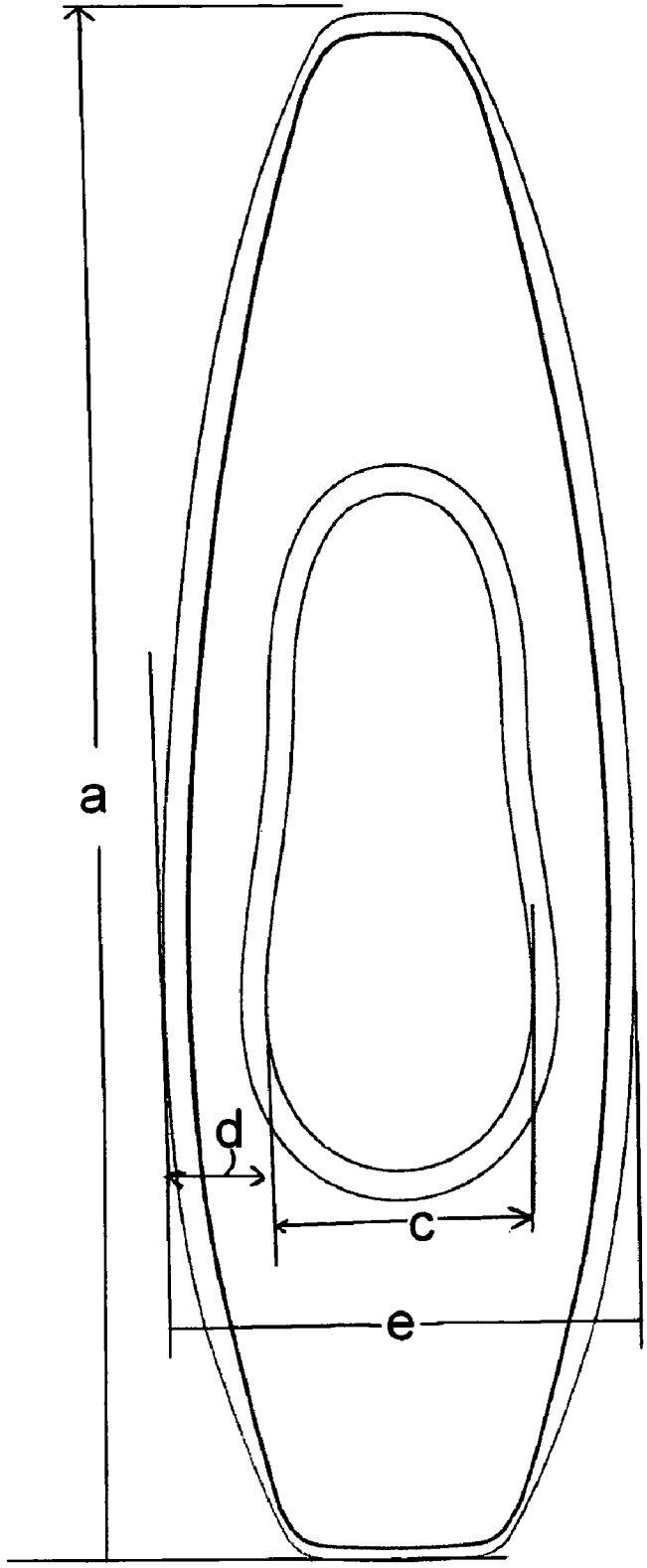
FIGS. 19 and 20 are similar to FIGS. 1 and 2, respectively, and are presented to show several dimensions of the kayak of this embodiment of the invention.
Figure 19:
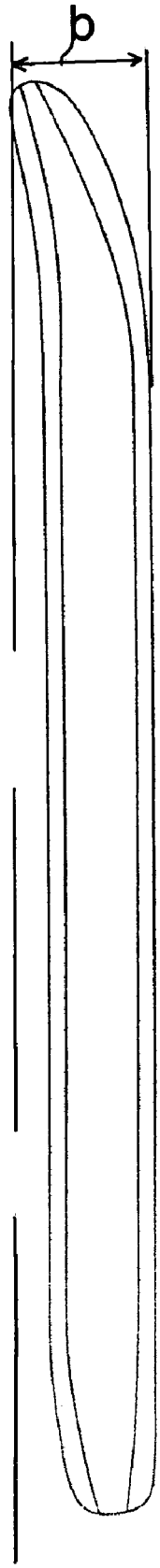

In FIGS. 19 and 20, there are shown several dimensions which would be acceptable in this embodiment of the kayak. The length dimension "a" could be approximately eleven feet in length, but could be made smaller or larger. The rise dimension indicated at "b" could be for example, in the vicinity of a foot, or possibly ten inches. The dimension "c" which is the maximum width dimension of the seating compartment could be approximately one half of the total width "e" of the kayak which could be about three feet. The dimension "d" which is shown to be the narrowest location of the flotation structure would be, for example, about one quarter of the total width "e". In terms of inch dimensions, in an actual kayak that is constructed with the drop stitch structure of eight inches could have a width dimension "d" of possibly as much as a foot or possibly down to a eight or nine inches.

With regard to the various dimensions of the components relative to each other, for example, the flotation structure could have a maximum width dimension, as indicated at "e" in FIG. 20, and the right and left flotation structure side portions could each have a width dimension as indicated at "d" in FIG. 20 of about a quarter of the dimension "e". Within a broader scope, the sum of the two width dimensions at "d" would be no less than one quarter of the maximum width dimension of the flotation structure at "e" and no greater than three quarters of the width dimension "e". Within a more narrow limit, the limitations would be no greater than about three fifths of the maximum dimension at "e" and no less than about two fifths. As an approximation, the sum of dimension "d" could be about one half of the maximum dimension of the width of the flotation structure.

Of course, it is to be understood that these dimensions are not to be strictly limited, and could be increased by percentages of twenty-five percent, fifty percent, seventy-five percent, and upwardly by further by twenty-five percent increments up until there was possibly two hundred percent higher. Also, some of these dimensions could be increased by substantial amounts, while other components would not have a corresponding increase, but a lesser or greater increase or no increase at all. Also, these dimensions could likely be decreased in increments down to ninety percent, eighty percent, seventy percent, sixty percent, fifty percent, or even as low as forty-five percent, forty percent or possibly lower. Also, some of these dimensions could be increased while others are decreased by increments of five percent or ten, fifteen, twenty, thirty, forty or higher, while other dimensions could be decreased by the same percentage values.

Figure 21:
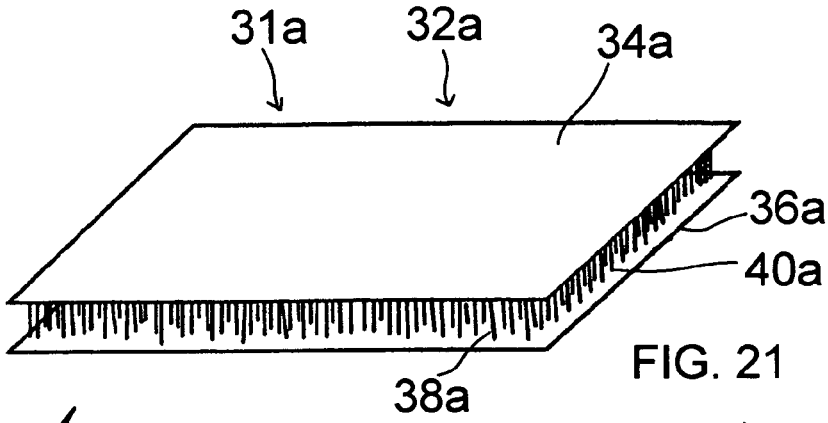
FIG. 21 shows a drop stitch structure which is basically the same as that shown in FIG. 3.
Figure 22:
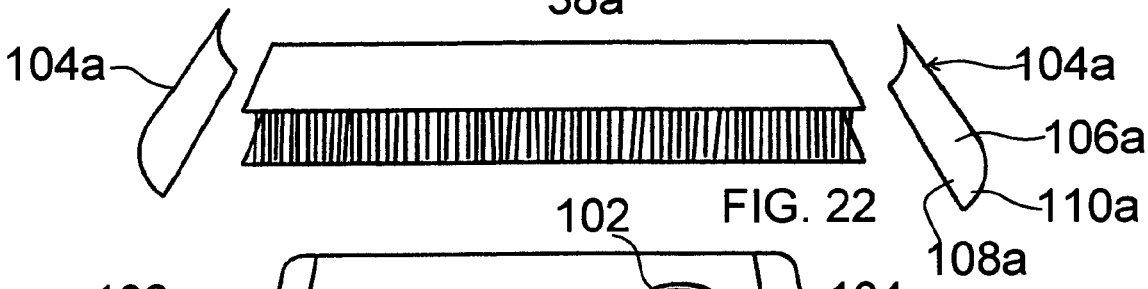
FIG. 22 is an isometric view also showing the drop stitch structure of FIG. 21 along with portions of sidewalls which close off opposite end portions of the drop stitch structure.
Figure 23:
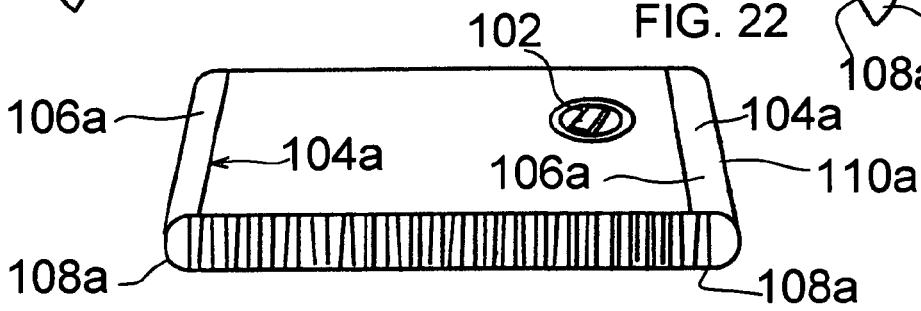
FIG. 23 illustrates the same structure as shown in FIG. 21 with the two side members being bonded to opposite side portions of the drop stitch structure.

A second embodiment of the present invention is shown in FIGS. 21, 22 and 23. Components of this second embodiment which are the same as, or similar to, components of the first embodiment shown herein, will be given like numerical designations with an "a" suffix distinguishing those of second embodiment.

The overall configuration of the kayak like boat of the first embodiment described in FIGS. 1-3 is the same as this second embodiment. This second embodiment differs in some respects only in the manner that the drop stitch structure 32*a* is enclosed to make the structure air tight and water tight.

Thus, in FIG. 21, there is shown a rectangular portion of the drop stitch fabric 32*a* which functions as the drop stitch structure 31*a*. This comprises the upper and lower fabric layers 34*a* and 36*a* which are connected to the core section 38*a* which in turn comprises a plurality of threads or cords 40*a*.

The manner in which this is accomplished in the first embodiment is shown in FIG. 11 and also in the descriptive text that is associated with FIG. 11. In FIG. 11, there are shown the upper and lower fabric layer 78 and 80 of the drop stitch structure 76, and there are edge extensions 83 of these upper and lower layers 78 and 80. Then the right and left side members 68 and 70 have their outer edge portions 82 overlapping with the portions 83. An adhesive material is placed between the two end pieces 82 and 83 to bond them together.

It is also stated that the overlap could be reversed so that the overlapping portions 83 would be on the outside and those on 82 would be on the inside.

Now to turn our attention to FIGS. 21, 22 and 23, the side edges of the upper and lower layers 34*a* and 36*a* are positioned quite close to the outer edge of 40*a* made up of the threads 28*a*.

Then there are provided two side closure members 104*a*, and each of these have upper and sower connecting edge portions 106*a* and 108*a*. Each of these edge portions 106*a* and 108*a* has an adhesive surface with a width dimension of, for example, one inch and possibly more or less. Such closure members are currently commercially available as EAM tape.

Then the main central portion 110*a* of each of these members 104*a* has a width dimension that is sufficient so that with the two edge portions 106*a* and 108*a* being in place overlapping with the edge portions of the drop stitch structure to make the proper bond, the middle portion 110*a* of each closure members 104*a* has sufficient width so that each middle portion 110 can form the rounded configuration that is shown in FIG. 23. This enables the adjacent portions of the drop stitch structure to function under full tension loads to get the full benefit of the drop stitch structure in resisting bending moments.

While the present invention is illustrated by description of several embodiments and while the illustrative embodiments are described in detail, it is not the intention of the applicants to restrict or in any way limit the scope of the invention. Additional advantages and modifications within the scope of the invention will readily appear to those sufficed in the art. The invention in its broader aspects is therefore not limited to the specific details, representative apparatus and methods. Accordingly, departures may be made from such details without departing from the spirit or scope of applicants' general concept.

I claim:

1. An inflatable boat comprising:

a. an inflatable flotation structure comprising upper and lower flotation structure layers with upper and lower flotation surfaces and further comprising front and rear flotation structure portions, and right and left flotation structure side portions spaced laterally from one another, said flotation structure defining a seating region located between the front and rear flotation structure portions and between the flotation structure side portions;

b. said flotation structure being arranged to comprise:

i. a drop stitch structure which comprises upper and lower drop stitch layers, with a core of threads connected to and extending between said upper and lower drop stitch layers, and which extends substantially throughout the flotation structure, with said upper and lower drop stitch layers comprising at least a substantial portion of upper and lower layers of the flotation structure;

ii. a flexible, water proof and air impervious outer wall section with upper and lower edge portions of the outer wall section to outer edge portions of the upper and lower drop stitch layers, respectively, of the drop stitch structure to enclose at least a substantial portion of the outer front, rear and side portions of the flotation structure;

iii. a flexible, water proof and air impervious inner wall section with upper and lower edge portions of the inner wall section bonded to inner edge portions of the upper and lower layers, respectively, of the drop stitch structure to enclose at least a substantial portion of the inner portion of the flotation structure that defines the seating compartment;

c. said upper and lower layers of the drop stitch structure, said outer wall section and said inner wall section defining an inflation chamber which extends throughout substantially the length of the flotation structure, with said inflation chamber being arranged to be inflated to a sufficiently high level to cause the flotation structure to function as a substantially rigid flotation structure.

2. An inflatable boat as recited in claim 1, wherein said outer sidewall section comprise an elongate central portion extending along the length of the sidewall section and two oppositely positioned elongate bonding edge portions at opposite edge locations of the side wall section, with the bonding edge portions of the side wall overlapping adjacent edge portions of an outer portion of the drop stitch layers and being bonded thereto.

3. An inflatable boat as recited in claim 2, wherein said edge portions of the drop stitch layers that are bonded to said edge portions of the outer wall section are also connected directly to related threads of the cord or threads so that when the flotation structure is inflated, there are direct tension forces exerted by air pressure within the flotation structure acting against the side outer wall edge portions to urge the edge portions of the side wall in place to be better able to resist bending moments imposed upon the drop stitch structure at the location of the outer wall.

4. An inflatable boat as recited in claim 1, wherein said flotation structure has a configuration characterized in that the width of the flotation structure is greater at a location of the seating compartment and side portions of front and rear flotation structure portions taper toward one another in a direction to, respectively, the front and rear ends of the flotation structure, with said outer wall section enclosing the inflation chamber extending to both front and rear end portions of the flotation structure.

5. An inflatable boat as recited in claim 1, wherein said outer wall section comprises right and left outer wall section portions which extend along the length of the flotation structure and are generally horizontally aligned, except that forward end portions of the outer wall section portions are formed to extend at an upward and forward slant so that a bottom forward portion of the flotation structure also slants forwardly and upwardly.

6. An inflatable boat as recited in claim 5, wherein said forward end portion of the flotation structure has an upper forward surface portion and a reinforcing layer is bonded to the upper forward surface portion of the flotation chamber to resist elongation of said upper forward surface portion to cause the forward end portion of the flotation structure to maintain the upward and forward slant of the forward end portion of flotation structure.

7. An inflatable boat as recited in claim 1, wherein the upper and lower layers of the drop stitch structure each comprise upper and lower fabric layers which are laminated between polymer layers.

8. An inflatable boat as recited in claim 2, wherein the elongate central portion is sufficiently wide relative to the distance between the two elongate edge portions so that upon inflation of the inflation chamber, the elongate contact portion is moved into a rounded configuration so that internal pressure in the inflation chamber is reached laterally into the drop stitch layers so that the ability of the flotation structure to resist bending moments is not compromised significantly.

9. An inflatable boat as recited in claim 3, wherein said elongate edge portions of the sidewall sections are substantially horizontal so as to be substantially perpendicular to adjacent threads of the drop stitch core so that lateral forces on the edge portions of the sidewall section are reached minimally into the core of the drop stitch structure and drop stitch structure is better able to resist bending moments on the flotation structure.

10. An inflatable boat as recited in claim 1, wherein said flotation structure has a maximum width dimension, indicated at "e" in FIG. 20, said right and left flotation structure side portions each have a width dimension with one of these being indicated at "d" in FIG. 20, and a sum of the width dimensions of the flotation structure side portions being no greater than about three quarters of the maximum width dimension of the flotation structure and no less than about one quarter of the maximum dimension of the flotation section.

11. An inflatable boat as recited in claim 1, wherein said flotation structure has a maximum width dimension, indicated at "e" in FIG. 20, said right and left flotation structure side portions each have a width dimension with one of these being indicated at "d" in FIG. 20, and a sum of the width dimensions of the flotation structure side portions being no greater than about three fifths of the maximum width dimension of the flotation structure and no less than about two fifths of the maximum dimension of the flotation section.

12. An inflatable boat as recited in claim 1, wherein said flotation structure has a maximum width dimension, indicated at "e" in FIG. 20, said right and left flotation structure side portions each have a width dimension with one of these being indicated at "d" in FIG. 20, and a sum of the width dimensions of the flotation structure side portions being about one half of the maximum width dimension of the flotation structure.

13. A method of making an inflatable boat comprising:

a. making an inflatable flotation structure comprising upper and lower surfaces, front and rear flotation structure portions, and right and left flotation structure side portions spaced laterally from one another, and arranging said flotation structure so that there is formed a seating region located between the front and rear flotation structure portions and between the flotation structure side portions;

b. as steps in making the flotation structure;

i. providing a drop stitch structure which comprises upper and lower drop stitch layers, with a core of threads connected to and extending between said upper and lower drop stitch layers and positioning said drop stitch structure to extend substantially throughout the entire flotation structure, with upper and lower layers of the drop stitch structure comprising at least a substantial portion of upper and lower layers of the flotation structure;

ii. providing an elongate flexible, water proof and air impervious outer wall section and bonding upper and lower edge portions of the outer wall member to the outer edge portions of the upper and lower layers, respectively, of the drop stitch structure to enclose a least a substantial portion of the outer front, rear and side portions of the flotation structure;

iii. providing a flexible, water proof and air impervious inner wall member and bonding upper and lower edge portions of the inner wall member to inner edge portions of the upper and lower layers, respectively, of the drop stitch structure to enclose at least a substantial portion of the inner portion of the flotation structure that defines the seating compartment;

c. arranging said upper and lower layers of the drop stitch structure, said outer wall and said inner wall so that there is provided an inflation chamber which extends throughout substantially the length of the flotation structure and also through the side portions of the flotation structure, with said inflation chamber being arranged to be inflated to a sufficiently high level to cause the flotation structure to be a substantially rigid flotation structure.

14. The method of making an inflatable boat as recited in claim 13 wherein, said outer sidewall section is provided as having an elongate central portion extending along the length of the sidewall section and two oppositely positioned elongate bonding edge portions at opposite edge locations of the side wall section, and positioning the bonding edge portions of the sidewall section overlapping adjacent edge portions of an outer portion of the drop stitch layers and bonding the edge portions to the drop stitch layers.

15. The method of making an inflatable boat as recited in claim 14, wherein said edge portions of the drop stitch layers that are being bonded to said edge portions of the outer wall section are also connected directly to related threads of the cord or threads so that when the flotation structure is inflated, there are direct tension forces exerted by air pressure within the flotation structure acting against the side outer wall edge portions to urge the edge portions of the side wall in place to be better able to resist bending moments imposed upon the drop stitch structure at the location of the outer wall.

16. The method of making an inflatable boat as recited in claim 13, wherein said flotation structure is provided with a configuration characterized in that the width of the flotation structure is greater at a location of the seating compartment and side portions of front and rear flotation structure portions taper toward one another in a direction to, respectively, the front and rear ends of the flotation structure, and positioning said outer wall section to be enclosing the inflation chamber extending to both front and rear end portions of the flotation structure.

17. The method of making an inflatable boat as recited in claim 13, wherein said outer wall section is provided as right and left outer wall section portions which extend along the length of the flotation structure and are generally horizontally aligned, except that forward end portions of the outer wall section portions are formed to extend at an upward and forward slant so that a bottom forward portion of the flotation structure also slants forwardly and upwardly.

18. The method of making an inflatable boat as recited in claim 13, wherein said flotation structure is configured in a manner to have a maximum width dimension, as indicated at "e" in FIG. 20, said right and left flotation structure side portions each have a width dimension with one of these being indicated at "d" in FIG. 20, and a sum of the width dimensions of the flotation structure side portions being no greater than about three quarters of the maximum width dimension of the flotation structure and no less than about one quarter of the maximum dimension of the flotation section.

19. The method of making an inflatable boat as recited in claim 13, wherein said flotation structure is configured to have a maximum width dimension, as indicated at "e" in FIG. 20, said right and left flotation structure side portions each have a width dimension with one of these being indicated at "d" in FIG. 20, and a sum of the width dimensions of the flotation structure side portions being no greater than about three fifths of the maximum width dimension of the flotation structure and no less than about two fifths of the maximum dimension of the flotation section.

20. The method of making an inflatable boat as recited in claim 13, wherein said flotation structure is configured to have a maximum width dimension, as indicated at "e" in FIG. 20, said right and left flotation structure side portions each have a width dimension with one of these being indicated at "d" in FIG. 20, and a sum of the width dimensions of the flotation structure side portions being about one half of the maximum width dimension of the flotation structure.

* * * * *